United States Patent [19]

Takaki et al.

[11] Patent Number: 4,506,002

[45] Date of Patent: Mar. 19, 1985

[54] DIFFUSION TRANSFER PHOTOGRAPHIC ELEMENTS WITH POLYMER GRAFTED PIGMENT

[75] Inventors: Hideki Takaki; Hiroshi Hayashi; Shigetoshi Ono; Hisashi Okamura, all of Kanagawa, Japan

[73] Assignee: Fuji Photo Film Co., Ltd., Kanagawa, Japan

[21] Appl. No.: 555,733

[22] Filed: Nov. 28, 1983

[30] Foreign Application Priority Data

Nov. 26, 1982 [JP] Japan ..... 57-207343

[51] Int. Cl.[3] ..... G03C 5/54; G03C 1/40; G03C 1/84

[52] U.S. Cl. ..... 430/215; 430/220; 430/227; 430/510; 430/517

[58] Field of Search ..... 430/215, 220, 227, 510, 430/517

[56] References Cited

U.S. PATENT DOCUMENTS 3,833,369 9/1974 Chiklis et al. ..... 430/215
4,444,866 4/1984 Sakai et al. ..... 430/220
4,450,222 5/1984 Mattes et al. ..... 430/220

*Primary Examiner*—Richard L. Schilling
*Attorney, Agent, or Firm*—Sughrue, Mion, Zinn, Macpeak and Seas

[57] ABSTRACT

A diffusion transfer photographic element composed of a photosensitive sheet, a cover sheet, and a processing composition contained in a rupturable container in such a manner that the processing composition is spread between both sheets after exposing the photosensitive sheet is disclosed. The whiteness of highlights of images obtained is improved by incorporating a graft carbon black polymer prepared by graft polymerizing a monomer to carbon black in the photographic element, in particular, in the light-shielding layer of the photosensitive sheet.

The graft carbon black polymer prepared by graft polymerizing a monomer to carbon black can be uniformly dispersed in an aqueous medium and thus the photographic properties of a diffusion transfer photographic element can be improved using the graft carbon black polymer.

27 Claims, No Drawings

DIFFUSION TRANSFER PHOTOGRAPHIC ELEMENTS WITH POLYMER GRAFTED PIGMENT

FIELD OF THE INVENTION

This invention relates to photography and, more particularly, the invention relates to diffusion transfer photographic elements adapted to provide photographic products with improved highlights.

BACKGROUND OF THE INVENTION

For increasing the whiteness of highlights (hereinafter, are referred to as Dmin) of lamination layer integral type color diffusion transfer photographic elements, various investigations such as, for example, the improvement of silver halide emulsions and dye-providing materials, and the addition of hydroquinones, etc., have hitherto been made. An attempt at capturing dyes unnecessary for images by adding a dye mordanting quaternary ammonium salt or a polymer thereof to a light-shielding layer of a diffusion transfer photographic element is proposed in U.S. Pat. Nos. 3,788,855, 3,898,088, etc.

The foregoing attempt may provide a large improvement effect but the attempt of further improving Dmin by the technique disclosed in the above-described patents causes a reduction of other photographic properties (e.g., reduction of maximum density, reduction of sensitivity, etc.) and hence the technique disclosed in the foregoing patents is unsuitable for a composite system of a lamination layer integral type color diffusion transfer photographic element.

Carbon black itself is oleophilic and an attempt at rendering carbon black hydrophilic by graft polymerizing carbon black with a polymer is disclosed in Japanese Patent Application (OPI) Nos. 147561/80, 81038/74, etc. (the term "OPI" indicates an unexamined published patent application open to public inspection). However, since the graft compound is usually obtained as a solution in ethanol or an ethanol/water solvent or is frequently dissolved in an aqueous ammonia solution at use, such a graft compound is not used for diffusion transfer photographic elements. Also, if a solvent such as ethanol is removed from the solution of the graft compound obtained in the foregoing techniques for using the graft compound for diffusion transfer photographic elements, the graft compound obtained by removing the solvent shows poor dispersibility in water and thus if such a graft compound of carbon black is used in the light-shielding layer, etc., of a diffusion transfer photographic element, the surface-smoothness of the coated layer containing the graft compound and uniform dispersion of the graft compound in the coated layer are reduced, whereby the light-shielding function which is the desired object of blackening the layer becomes insufficient.

The conventionally known graft compound obtained by grafting carbon black to a polymer as described above is unsuitable for diffusion transfer photographic elements.

SUMMARY OF THE INVENTION

The object of this invention is to greatly increase the photographic properties including Dmin of diffusion transfer photographic elements, in particular, lamination layer integral type color diffusion transfer photographic elements without causing other undesirable influences.

As a result of various investigations, the inventors have discovered that the foregoing object of this invention can be attained by using the photographic element of this invention as will be described hereinafter.

That is, the invention is a diffusion transfer photographic element containing a polymer compound obtained by graft polymerizing a monomer compound to a pigment.

DESCRIPTION OF PREFERRED EMBODIMENTS

A preferred embodiment of this invention is a diffusion transfer photographic element having on a support at least one of a photographic silver halide emulsion layer and an image-receiving layer, and the photographic silver halide emulsion and the image-receiving layer may be each a single layer or multiple layers, wherein the photographic element contains a polymer compound obtained by graft polymerizing a monomer compound to a pigment.

A more preferred embodiment of this invention is a diffusion transfer photographic element having on a same or different support from each other at least one photographic silver halide emulsion layer and at least one image-receiving layer together with other layer(s), wherein at least one layer other than said silver halide emulsion layer and image-receiving layer contains a polymer compound obtained by graft-polymerizing a monomer compound to a pigment.

A far more preferred embodiment of this invention is a color diffusion transfer photographic element having on a same or different support from each other at least one photographic silver halide emulsion layer and at least one image-receiving layer, wherein at least one photographic silver halide emulsion layer has associated therewith a dye image-providing material and said photographic element contains a polymer compound obtained by graft polymerizing a monomer compound to a pigment.

A still far more preferred embodiment of this invention is a lamination layer integral type color diffusion transfer photographic element having on a same or different support from each other at least one photographic silver halide emulsion layer having associated therewith a dye image-providing material and at least one image-receiving layer, said support and said layers being in a laminated state, wherein at least one layer of said photographic element contains a polymer compound obtained by graft copolymerizing a monomer compound to a pigment.

The term "pigment" used in this invention includes a so-called inorganic pigment and an organic dye. For example, the term includes inorganic white pigments (e.g., titanium oxide, barium sulfate, zinc oxide, etc.), black pigments (e.g., carbon black, etc.), and organic dyes (e.g., anthraquinone series dyes, etc.), etc.

Carbon black used in the practice of this invention includes channel black, thermal black, furnace black, etc., produced by any optional production process. There is no particular restriction with respect to the particle size of the carbon black used in this invention but carbon black having a particle size of 90 to 1,800 Å is preferred.

The grafting rate of the graft carbon can be measured by a Soxhlet extraction method or simply by an elemental analysis, etc., and is preferably 1 to 200%. For further improving the dispersibility or the foregoing properties of the graft carbon, the grafting rate is more preferably 5 to 100%. Graft carbon may be used as it is after reaction or may be used after removing inorganic salts or monomers remained, etc., by dialysis. Furthermore, graft carbon only separated by centrifugal separation after reaction can be used in this invention.

Moreover, for further improving the dispersibility of carbon black into water, the carbon black may be dispersed by a mechanical means or by using a dispersing agent such as a surface active agent, etc., before or after grafting.

For performing the grafting reaction of a monomer compound to carbon black, the method generally employed for grafting a monomer compound to a polymer can be similarly used. For example, there are a method of grafting a monomer to carbon black by radical attack, a method of grafting a monomer compound to carbon black by free radical, a method by an ionic mechanism, a mechanical method, a method by a light or radiation irradiation, etc. These general methods are described in, for example, A. S. Hoffman and R. Bacskai, *Copolymerization,* page 335; R. J. Ceresa, *Block and Graft Copolymerization,* Vols. 1 and 2; *Kobunshi Hanno* (*High Molecular Reaction*) published by Kobunshi Gakkai (High Molecular Society), etc.

Practical examples of monomers used for making the polymer compounds used in this invention by grafting to pigments such as carbon black are, considering the water dispersibility of the pigment, water-soluble monomers. Examples of such include anionic monomers such as crotonic acid, fumaric acid, itaconic acid, acrylic acid, methacrylic acid, maleic acid, aconitic acid, citraconic acid, malic acid, 3-acryloxypropionic acid, 2-acryloxyethylphosphoric acid, chlorofumaric acid, α-chloroacrylic acid, monoethylfumaric acid, monomethylfumaric acid, monomethylitaconic acid, mesaconic acid, α-methyleneglutaric acid, monododecylitaconic acid, monooctylitaconic acid, styrenesulfonic acid, 2-acrylamido-2-methylpropanesulfonic acid, ethylenesulfonic acid, 3-allyloxy-2-hydroxypropanesulfonic acid, 3-acrylamidopropanesulfonic acid, vinylphenylmethanesulfonic acid, 2-acrylamido-2-methylpropanesulfonic acid, styrenesulfinic acid, and the salts of these acids; nonionic monomers such as acrolein, acrylamide, methacrylamide, N-methylolacrylamide, N,N-dimethylaminoethylacrylamide, N,N-dimethylaminopropylacrylamide, hydroxyethyl methacrylate, N,N-dimethylaminoethyl acrylate, N,N-dimethylaminoethyl methacrylate, poly(ethyloxy) acrylate, poly(ethyloxy) methacrylate, 2-vinylpyridine, 4-vinylpyridine, 1-vinyl-2-pyrrolidone, 1-vinylimidazole, 1-vinyl-2-methylimidazole, etc.; cationic monomers such as vinylbenzyl trimethylammonium salt, vinylbenzyl triethylammonium salt, vinylbenzyl tripropylammonium salt, vinylbenzyldimethylamine hydrochloride, methacryloxyethyl trimethylammonium salt, acryloxyethyl trimethylammonium salt, acrylamidoethyl trimethylammonium salt, acrylamidopropyl trimethylammonium salt, methacrylamidoethyl trimethylammonium salt, methacryloxyethyl dimethylethylammonium salt, N,N-dimethylaminoethyl methacrylate hydrochloride, etc.; pair ion monomers such as 3-(2-methyl-5-vinylpyridino)propylsulfonic acid, etc.; although the monomers used in this invention are not restricted to these monomers.

Of these monomers, the anionic monomers such as 2-acrylamido-2-methylpropanesulfonic acid, vinylphenylmethanesulfonic acid, 3-acrylamidopropanesulfonic acid, acrylic acid, methacrylic acid, etc., and the salts thereof (such as alkali metal salt) are particularly preferred considering, in particular, the interaction with gelatin and the foregoing properties.

The grafting reaction may be performed in the presence of a polymerization initiator described in the foregoing literature on the general polymerization methods, such as, for example, benzoyl peroxide, azobisisobutyronitrile, potassium persulfate, ammonium persulfate, lauryl peroxide, dicumyl peroxide, t-butyl peroxide, cumene hydroperoxide, etc. In these polymerization initiators, the persulfates are particularly preferred. The foregoing polymerization initiators may be used solely or as a combination of two or more initiators.

Carbon black may be peroxidized before being subjected to the grafting reaction and examples of the peroxidizing agent are t-butyl peroxide, oxygen, ozone, hydrogen peroxide, sodium hypochlorite, a persulfate, benzoyl peroxide, etc. The peroxidizing agents for carbon black above described may be used solely or as a combination of two or more agents.

Also, for peroxidizing the hydroxy group on carbon black, N,N,N',N'-tetramethylethylenediamine, etc., may be used as a radical transfer in addition to the polymerization initiator.

Furthermore, a redox mechanism using a cerium (IV) salt may be applied for converting the α carbon of the alcohol group of carbon black into a radical.

By using the carbon black graft polymer of this invention, Dmin is lowered to make more clear the white portion of a photograph and the colors of monochromatic portions (yellow, magenta and cyan) of dyes become more bright by the increased whiteness of the background portions, whereby the image quality of images obtained is greatly improved.

Another feature of this invention is that since a large mechanical shearing stress is applied for dispersing carbon black in a conventional technique, the apparatus required for obtaining the graft polymer is large as is the energy loss. However, when producing the graft polymer of carbon black in this invention, a large energy is not required and hence there are desirable aspects with respect to the apparatus, production step, and energy loss for attaining a desired dispersion by only stirring.

Still another feature of this invention is that when using carbon black for a processing composition for color diffusion transfer photographic element, it is necessary to mix carbon black with a highly viscous binder. The carbon black aggregates when using a conventional technique causing pinholes on images due to the aggregation of carbon black. However, the graft polymer compound of carbon black in this invention has a very high stability, whereby the aggregation of carbon black does not occur and the formation of pinholes is less.

In a further feature of this invention the graft polymer compound of carbon black in this invention shows less adhesion to glass and metal, which gives such an unexpected merit that cleaning of equipment used for the production and treatment of the graft polymer can be facilitated.

In still another feature of this invention the graft carbon black compound of this invention reduces the viscosity thereof (lower than 10 centipoise, preferably lower than 5 centipoise) as the progress of effective grafting and the fluidity thereof approaches that of Newtonian flow. Therefore, when mixing the graft carbon black compound with another material (e.g., gelatin), local masses are not formed and uniform mixing can be sufficiently obtained by low-speed stirring.

A typical photographic material for obtaining a color diffusion transfer photographic print using the photographic element of this invention is the embodiment as shown below. However, the scope of the invention is not limited to this material.

A typical photographic material is a so-called "lamination layer integral type" photographic material composed of a photosensitive sheet having on a transparent support an image-receiving layer, a white reflecting layer, a light-shielding layer containing carbon black, a layer containing a cyan dye image-providing material, a red-sensitive silver halide emulsion layer, an interlayer, a layer containing a magenta dye image-providing material, a green-sensitive silver halide emulsion layer, an interlayer, a yellow dye image-providing material, a blue-sensitive silver halide emulsion layer, and a protective layer; a cover sheet having on another transparent support a neutralizing layer and a neutralization timing layer; said photosensitive sheet being disposed on said cover sheet in a face-to-face relationship; and a pressure rupturable container containing a processing composition containing carbon black; said container being disposed at a position capable of spreading the processing composition between both the foregoing sheets; said three elements being fixed in a unitary state.

In the foregoing embodiment of this invention, it is preferred that carbon black contained in the light-shielding layer is the polymer compound obtained by graft polymerizing the monomer compound to carbon black. Furthermore, in the foregoing embodiment of this invention, it is also preferred that carbon black contained in the processing composition is the polymer compound obtained by graft polymerizing the monomer compound to carbon black.

Practical examples of the diffusion transfer photographic film units of this invention are described in, for example, U.S. Pat. No. 3,594,164, British Patent 1,330,524 and James et al., *The Theory of Photographic Process,* page 367 (published by Macmillan Co., 1977).

The light-shielding layer used in this invention can be formed as a layer in the photosensitive sheet and/or a layer of the processing composition.

In the case of using the light-shielding layer in the photosensitive sheet, the light-shielding layer may be formed at the position disclosed in U.S. Pat. No. 3,594,164 and British Patent No. 1,330,524 using a compound such as gelatin, carboxymethyl cellulose, hydroxyethyl cellulose and polyvinyl alcohol as a binder. A particularly preferred binder is gelatin. The ratio of a pigment (carbon black in the graft polymer) to a binder is 1/2 to 20/1 by weight ratio, preferably 1/1 to 5/1 by weight ratio.

The graft polymer of carbon black can be mixed with gelatin by gradually adding a predetermined amount of gelatin to the carbon black graft polymer solution with stirring. If there is a tendency to cause aggregation of the solution or mixture, the mixture may be dispersed by means of a high-speed impeller type dispersing machine such as a desolver (e.g., Auto Homo Mixer, trade name, made by Tokushu Kikai Kogyo K.K.) or Polytron (trade name, made by Kinematica Co.), whereby a dispersion with good dispersibility is obtained. Also, the mixture may, as a matter of course, be dispersed by means of a dispersing machine such as a sand mill, ball mill, and dynomill although the scale of the dispersing system is increased.

The coating amount of carbon black depends upon the necessary light-shielding faculty but is generally 0.5 to 5.0 g/m$^2$, and preferably 1.0 to 3.0 g/m$^2$, as a solid content.

In this invention it is preferred to use the polymer compound obtained by graft polymerizing the monomer compound to pigment as an aqueous dispersion thereof but the polymer compound may be used as a relatively oleophilic dispersion if the photographic effect is not reduced.

The light-shielding layer can be formed by adding a surface active agent (a coating aid), a hardening agent, a thickener, etc., to the dispersion of the carbon black graft polymer compound and coating the dispersion by a desired coating means. Also, if desired, the pH of the dispersion may be adjusted to a desired value by the addition of an acid or an alkali before coating.

The processing composition used in this invention is a liquid composition containing processing components necessary for the development of silver halide emulsion layers and the formation of diffusion transfer dye images and containing the carbon black graft polymer of this invention for preventing the silver halide emulsion layers from being fogged by external light during processing. It is, as the case may be, advantageous that the processing composition further contains a light-absorbing material such as $TiO_2$, a pH indicator, etc., and a desensitizer as described in U.S. Pat. No. 3,579,333.

Furthermore, the processing composition contains a developing agent necessary for performing the development. Examples of the developing agents used for the development of the photographic element of this invention include hydroquinones; aminophenols; phenylenediamines; pyrazolidinones (e.g., phenidone, dimmeson, 1-p-tolyl-4-methyl-4-hydroxymethyl-3-pyrazolidinone, 1-(4'-methoxyphenyl)-4-methyl-4-hydroxymethyl-4-pyrazolidinone, 1-phenyl-4-hydroxymethyl-3-pyrazolidinone, 1-p-toly-4,4-dihydroxymethyl-3-pyrazolidone, 1-m-tolyl-4-methyl-4-hydroxymethyl-3-pyrazolidone), etc., as described in U.S. Pat. No. 4,336,322. Also, as the developing agent used for silver salt diffusion tranfer photography, there are hydroxylamines described in U.S. Pat. Nos. 3,362,961, 3,293,034, 3,467,711, 3,491,151, 3,655,764, etc.

The solvent of the processing composition is mainly water and contains, as the case may be, a hydrophilic solvent such as methanol, methyl cellosolve, etc. The processing composition contains an alkali in an amount sufficient for maintaining the pH necessary for causing the development of silver halide emulsion layers and for neutralizing acids (e.g., a hydrohalogenic acid such as hydrobromic acid, etc., and carboxylic acid such as acetic acid, etc.) formed during various steps of development and dye image formation. Examples of the alkali used for the purpose are alkali metal or alkaline earth metal salts such as sodium hydroxide, lithium hydroxide, potassium hydroxide, a calcium hydroxide dispersion, tetramethylammonium hydroxide, sodium carbonate, sodium tertiary phosphate, etc., and amines such as diethylamine, etc. It is particularly preferred that the processing composition contain an alkali metal hydroxide at a concentration such that it provides a pH higher than about 12, particularly 14, at room temperature.

Also, it is more preferred that the processing composition contain a hydrophilic polymer such as polyvinyl alcohol having a high molecular weight, hydroxyethyl cellulose, sodium carboxymethyl cellulose, etc. Such a polymer not only gives a viscosity of higher than 1 poise, preferably about 500 to 1,000 poises at room temperature to the processing composition to facilitate the uniform spread of the processing composition at processing but also forms a non-fluid film when the processing composition is concentrated by the transfer of the aqueous solvent in the processing composition into the photosensitive element and the image-receiving element in the step of processing to assist the integration of the film unit after processing. The polymer film can contribute to preventing the images formed from being changed by inhibiting the further transfer of coloring components into the image-receiving layer after substantially finishing the formation of diffusion transfer color images.

Furthermore, the processing composition can further contain a development restrainer such as benzotriazole.

The foregoing processing composition is preferably used in the rupturable container as described in U.S. Pat. Nos. 2,543,181, 2,643,886, 2,653,732, 2,723,051, 3,056,491, 3,056,492, 3,152,515, etc.

The addition amount of carbon black to the processing composition depends upon the necessary light-shielding effect but is usually 15 to 500 g, preferably 50 to 250 g, based on the solid content of carbon black per kilogram of the processing composition.

From the graft carbon black polymer compound used in this invention may, if desired, be removed a remaining monomer, a polymerization initiator, etc., by dialysis, etc., but if photographic properties are not reduced, the remaining monomer, a homopolymer formed without grafting, and the initiator may remain in the graft carbon black polymer compound.

The foregoing explanations described in connection with this invention relate mainly to using carbon black as the pigment but other pigment, for example, a white pigment such as titanium oxide, zirconium oxide, barium sulfate, zinc oxide, etc., may be also used as the pigment in this invention although the use of carbon black is particularly preferred. In the case of using carbon black as the pigment, the graft polymer compound of the pigment may be incorporated in the processing composition in the layer structures as described in, for example, U.S. Pat. Nos. 3,415,644, 3,415,645 and 3,415,646 or in the light-reflecting layer in the structures as described in foregoing U.S. Pat. No. 3,594,164 and British Pat. No. 1,330,524. As a matter of course, the graft carbon black polymer compound may be used solely or together with non-grafted carbon black.

The graft polymer compound of a pigment used in this invention can be incorporated in any desired layer or layers of a diffusion transfer photographic element, in particular, a lamination integral type color diffusion transfer photographic element if it does not reduce photographic properties of the photographic element.

The photosensitive silver halide emulsions used in this invention are hydrophilic colloidal dispersions of silver chloride, silver bromide, silver chlorobromide, silver iodobromide, silver chloroiodobromide, or a mixture of them. The halogen composition of the silver halide emulsion is selected according to the using purpose of the photographic materials and processing conditions but it is preferred that the content of iodide be lower than 10 mol%. The silver halide grains used in this invention may be regular particles or twinning grains such as multiple twinning grains (parallel or non-parallel). These silver halide emulsions may be prepared by the conventional manners as described in, for example, P. Glafkides, *Chimie Photographique,* 2nd Edition, Chapters 18–23 (1957) (Paul Montel, Paris).

It is preferred that the silver halide emulsions used in this invention be chemically sensitized by a natural sensitizer contained in gelatin; a sulfur sensitizer such as sodium thiosulfate or N,N,N'-triethylthiourea; a gold sensitizer such as a thiocyanate complex or thiosulfate complex of monovalent gold; or a reduction sensitizer such as stannous chloride, hexamethylene tetramine in combination with heat treatment.

In this invention an ordinary negative-type silver halide emulsion easily forming a latent image on the surface of the silver halide grains or a so-called direct reversal silver halide emulsion (e.g., an internal latent image-type silver halide emulsion or a solarization-type silver halide emulsion), which is developed at unexposed portions, may be used. The useful solarization-type silver halide emulsions are described in, for example, James, *The Theory of the Photographic Process,* pages 182–193 (1977, Macmillan Co., New York). The preparation methods for the solarization-type silver halide emulsions are described in, for example, British Patent Nos. 443,245 and 462,730, U.S. Pat. Nos. 2,005,837, 2,541,472, 3,367,778, 3,501,305, 3,501,306, 3,501,307, etc.

Also, internal latent image-type direct positive silver halide emulsions are described in, for example, U.S. Pat. Nos. 2,497,875, 2,588,982, 2,456,953, 3,761,276, 3,206,313, 3,317,322, 3,761,266, 3,850,637, 3,923,513, 3,736,140, 3,761,267, 3,854,949, etc. In the case of using the direct reversal photographic silver halide emulsions, direct positive images can be obtained by developing the silver halide emulsion layers in the presence of a fogging agent after image exposure or by applying overall exposure to the silver halide emulsion layers (high illuminance, short period exposure, i.e., exposure shorter than $10^{-2}$ sec. or low illuminance, long period exposure) during surface development processing after image exposure to fog the emulsion layers as described in U.S. Pat. No. 2,456,953 (Knott and Stevens). The use of a fogging agent is preferred in that the extent of the fogging can be easily controlled. The fogging agent may be incorporated in the photosensitive material or in the developer but it is preferably incorporated in the photosensitive material. Typical examples of the fogging agent for the type of silver halide emulsions are hydrazines described in U.S. Pat. Nos. 2,588,982 and 2,568,785; hydrazides and hydrazones described in U.S. Pat. No. 3,227,552; the quaternary compounds described in British Pat. No. 1,283,835, Japanese Patent Publication No. 38164/74, U.S. Pat. Nos. 3,734,738, 3,719,494, 3,615,615, 4,115,122, etc.; and the acylhydrazinophenylthiourea series compounds described in West German Patent Application (OLS) No. 2,635,316.

The amount of the fogging agent used in this invention can be changed over a wide range according to the desired result. In the case of incorporating the fogging agent in the photographic material, the amount of the fogging agent depends upon the nature of the fogging agent but is usually 0.1 to 1,500 mg per mol of Ag, preferably 0.5 to 700 mg per mol of Ag.

In the case of incorporating the fogging agent in the developer or processing composition, the concentration of it is generally about 0.05 to 5 g (preferably 0.1 to 1 g) per liter of the developer.

In the case of incorporating the fogging agent in a layer of the photosensitive material, it is effective for the purpose to render the fogging agent non-diffusible.

As the means for rendering the fogging agent non-diffusible, it is effective to combine the fogging agent with a ballast group usually used for photographic couplers.

The silver halide emulsions used in this invention can be stabilized by a conventional stabilizer. Furthermore, the silver halide emulsion used in this invention may further contain a sensitizing compound such as a polyethylene oxide compound.

The silver halide emulsions used in this invention may be, if desired, subjected to a spectral sensitization. Useful spectral sensitizers are cyanines, merocyanines, holopolar cyanines, styryls, hemicyanines, oxonols, hemioxonols, etc. Practical examples of the spectral sensitizers are described in P. Glafkides, *Chimie Photographique,* 2nd Edition, Chapters 35–41 and F. M. Hamer, *The Cyanine and Related Compounds* (Interscience). In particular, cyanines the nitrogen atom of the basic heterocyclic nucleus of which is substituted by an aliphatic group (e.g., an alkyl group) having a hydroxy group, carboxy group, sulfo group, etc., as described in, for example, U.S. Pat. Nos. 2,503,776, 3,459,553 and 3,177,210 are advantageous for the practice of this invention.

The dye image-providing material used in this invention is of a negative type or positive type as is known in the field of the art, and is initially mobile or immobile in the photographic element when processed by an alkaline processing composition.

The negative-type dye image-providing material useful in this invention is, for example, a coupler forming or releasing a dye by causing a reaction with an oxidized color developing agent and practical examples of the material are described in U.S. Pat. No. 3,227,550 and Canadian Pat. No. 602,607. As the preferred negative type dye image-providing material used for this invention, there is a dye releasing redox compound (DRR compound) releasing a dye by causing a reaction with a developing agent in an oxidized state or an electron transferring agent and practical examples of such materials are described in Japanese Patent Application (OPI) Nos. 33826/73, 54021/79, 113624/76 and 71072/81.

As the immobile positive type dye image-providing material used in this invention, there is a compound which releases a diffusible dye without receiving electron (i.e., without being reduced) or after receiving at least one electron (i.e., after being reduced) during photographic processing under an alkaline condition.

Furthermore, as the effective positive type dye image-providing material which is mobile from the beginning under an alkaline photographic processing condition, there is a dye developing agent and typical examples of it are described in Japanese Patent Publication Nos. 32130/73 and 22780/80.

The dye formed from the dye image-providing material used in this invention may be a dye itself or a dye precursor which can be converted into dye in a photographic processing step or an addition processing step. Also, the final image-forming dye may or may not be metallized. As the typical dye structure useful in this invention, there are azo dyes, azomethine dyes, anthraquinone dyes, phthalocyanine dyes, etc., which may be or may not be metallized. In these dyes, azoic cyan, magenta, and yellow dyes are particularly important.

Practical examples of the yellow dye image-providing material used in this invention are described in Japanese Patent Publication No. 2618/74, U.S. Pat. No. 3,309,199, Japanese Patent Publication No. 12140/82, Japanese Patent Application (OPI) Nos. 114930/76, 111344/79, 16130/81, 71072/81, 79031/79, 64036/78 and 23527/79, U.S. Pat. Nos. 4,148,641 and 4,148,643, and *Research Disclosure,* 17630 (1978), ibid., 16475 (1977).

Practical examples of the magenta dye image-providing material used in this invention are described in U.S. Pat. No. 3,453,107, Japanese Patent Publication No. 43950/71, Japanese Patent Application (OPI) No. 106727/77, U.S. Pat. Nos. 3,932,380, 3,931,144 and 3,932,308, Japanese Patent Application (OPI) Nos. 115528/75, 106727/77, 23628/78, 65034/79, 36804/80, 161332/79, 4028/80, 73057/81, 71060/81, 134/80 and 35533/78, and U.S. Pat. Nos. 4,207,104 and 4,287,292.

Furthermore, practical examples of the cyan dye image-providing material used in this invention are described in Japanese Patent Publication No. 32130/73, Japanese Patent Application (OPI) Nos. 8827/77, 126331/74, 109928/76, 99431/79, 149328/78, 47823/78, 143323/78, 71061/81, 64035/78 and 121125/79, U.S. Pat. Nos. 4,142,891, 4,195,994, 4,147,544 and 4,148,642, European Pat. Nos. 53,037 and 53,040, *Research Disclosure,* 17630 (1978), ibid., 16475, (1975), and ibid., 16475 (1977).

Also, as one kind of a dye precursor, a dye releasing redox compound having a dye moiety which temporarily shifts the light absorption in the photosensitive element can be used in this invention and practical examples are described in Japanese Patent Application (OPI) Nos. 53330/80 and 53329/80, U.S. Pat. Nos. 3,336,287, 3,579,334 and 3,982,946, and British Pat. No. 1,467,317.

When using DRR compounds in this invention, any silver halide developing agent which can cross-oxidize these compounds can be used. Such a developing agent may be incorporated in the alkaline processing composition (processing element) or in a proper layer of the photographic element. Practical examples of the developing agent used in this invention are those as described in page 15 line 21 to page 16 line 6 of this application.

In the foregoing developing agents, black-and-white developing agents having a property of reducing the formation of stain in the image-receiving layer (mordanting layer or dyeable layer) are particularly preferred as the case of incorporating in the alkaline processing composition described before.

At the practice of this invention, when a so-called ordinary type silver halide emulsion which is developed in accordance with the exposure amount is used in the case of using the DRR compound, a negative image is formed as the transferred image leaving a positive image in the photosensitive element. On the other hand, when the foregoing direct reversal silver halide emulsion which is developed at the unexposed portions is used in the same case, a positive image is obtained in the image-receiving layer of the film unit.

Furthermore, a transferred positive image can be obtained in this invention by the DIR reversal silver halide emulsion system as described in U.S. Pat. Nos. 3,227,551, 3,227,554 and 3,364,022 or by the reversal silver halide emulsion system by dissolution physical development as described in British Pat. No. 904,364. A series of processes for obtaining color diffusion transfer photographic images employed in this invention are described in U.S. Pat. Nos. 3,227,550 and 3,227,552 and British Pat. No. 1,330,524.

Typical examples of the color developing agent in the case of diffusible dye-releasing coupler in this invention are the p-phenylenediamine derivatives described in U.S. Pat. Nos. 3,227,552, 2,559,643 and 3,813,244. Furthermore, the p-aminophenol derivatives as described in Japanese Patent Application (OPI) No. 26134/73 can be advantageously used in this invention. Such a color developing agent is preferably contained in a rupturable container. The color developing agent may be incorporated in a layer additionally formed in the negative portion of the film unit or may be incorporated in the silver halide emulsion layer.

The support used in this invention is preferably composed of a material which does not cause severe deformation during processing. Examples of the support are a cellulose acetate film, a polystyrene fulm, a polyethylene terephthalate film, a polycarbonate film, etc., used for ordinary photographic materials. Other examples of the effective support are a paper and a paper laminated thereon a water-impermeable polymer such as polyethylene.

The diffusion transfer photographic element of this invention can be used not only for color diffusion transfer photography but also for the silver salt diffusion transfer photography as described in C. B. Neblette, *Photography, Its Materials and Processes,* 6th Edition, pages 368–391, Jogn M. Sturage, *Neblett's Handbook of Photography and Reprography, Materials, Processes, and Systems,* 7th Edition, pages 247–255.

The image-receiving layer used in this invention preferably contains a mordanting polymer. As the mordanting polymer, there are a polymer having a secondary or tertiary amino group, a polymer having a nitrogen-containing heterocyclic moiety, and a polymer having the quaternary cation, each polymer having a molecular weight of preferably higher than 5,000, more preferably higher than 10,000.

Examples of the mordanting polymer are the vinylpyridine polymers and vinylpyridinium cation polymers disclosed in U.S. Pat. Nos. 2,548,564, 2,484,430, 3,148,061 and 3,756,814; the vinylimidazolium cation polymers disclosed in U.S. Pat. No. 4,124,386; the mordanting polymer capable of cross-linking with gelatin, etc., disclosed in U.S. Pat. Nos. 3,625,694, 3,859,096 and 4,128,538 and British Pat. No. 1,277,453; the aqueous soltype mordants disclosed in U.S. Pat. Nos. 3,958,995, 2,721,852, 2,798,063, and Japanese Patent Application (OPI) Nos. 115228/79, 145529/79, 126027/79, 155835/79 and 17352/81; the water-insoluble mordants disclosed in U.S. Pat. No. 3,898,088; the reactive mordants capable of causing covalent bonding with a dye disclosed in U.S. Pat. Nos. 4,168,976 and 4,201,840; and the mordants disclosed in U.S. Pat. Nos. 3,709,690, 3,788,855, 3,642,482, 3,488,706, 3,557,066, 3,271,147, 3,271,148, Japanese Patent Application (OPI) Nos. 30328/78, 155528/77, 125/78, 1024/78, 107835/78, and British Pat. No. 2,064,802.

Further, the mordants disclosed in U.S. Pat. Nos. 2,675,316 and 2,888,156 can be used in this invention.

For the neutralizing layer used in this invention, any acid polymers having a film-forming property can be preferably used and examples of such acid polymers are monobutyl ester of a copolymer of maleic anhydride and ethylene, a monobutyl ester of a copolymer of maleic anhydride and methyl vinyl ether, a monoethyl ester of a copolymer of maleic anhydride and ethylene, a monopropyl ester of the aforesaid copolymer, a monopentyl ester of the aforesaid copolymer, a monohexyl ester of the aforesaid copolymer, a monoethyl ester of a copolymer of maleic anhydride and methyl vinyl ether, a monopropyl ester of the aforesaid copolymer, a monobenzyl ester of the aforesaid copolymer, a monohexyl ester of the aforesaid copolymer, polyacrylic acid, polymethacrylic acid, copolymers of acrylic acid and methacrylic acid in various ratios, and various copolymers of acrylic acid or methacrylic acid and other vinylic monomer (e.g., an acrylic acid ester, a methacrylic acid ester, a vinyl ether, an acrylamide, a methacrylamide, etc., in various ratios, preferably having an acrylic acid or methacrylic acid content of 50 to 90 mol%).

The neutralizing layers employed in this invention are described in U.S. Pat. Nos. 3,362,819, 3,765,885 and 3,819,371 and French Pat. No. 2,290,699. In the polymers and copolymers illustrated above, polyacrylic acid and an acrylic acid-butyl acrylate copolymer are particularly preferred in this invention.

For the neutralization timing layer used in this invention, gelatin, polyvinyl alcohol, polyacrylamide, partially hydrolyzed polyvinyl acetate, a copolymer of $\beta$-hydroxyethyl methacrylate and ethyl acrylate, or acetyl cellulose is used as the main component. Other materials described in U.S. Pat. Nos. 3,455,686, 3,421,893, 3,785,815, 3,847,615 and 4,009,030, and Japanese Patent Application (OPI) No. 14415/77 can be also used for the neutralization timing layer in this invention. Moreover, the foregoing neutralization timing layer can be used together with a polymer layer having a permeability for an alkaline processing solution greatly depending upon a temperature as described in U.S. Pat. Nos. 4,056,394 and 4,061,496, Japanese Patent Application (OPI) Nos. 72622/78 and 78130/79.

The invention will now be practically explained together with the merits of this invention in the following examples. However, the scope of the invention is not limited to these examples.

Production of Graft Carbon

Preparation 1: Process of using acrylic acid monomer

While stirring 60 g of carbon black (Elftex 5, trade name, made by Cabot Corporation) and 400 ml of water at 95° C, 12 g of potassium persulfate and 1.2 ml of tetramethylethylenediamine were added to the mixture. After stirring the mixture for 2 hours at 95° C., an aqueous sodium acrylate solution (a mixed solution of 250 ml of water, 33.3 g of sodium hydroxide, and 60 g of acrylic acid) was added to the mixture and after further adding 5.32 g of potassium persulfate and 2.68 ml of tetramethylethylenediamine to the mixture, the reaction was performed for 46 hours at 98° C. After allowing the reaction mixture to cool and removing dust therefrom, graft carbon formed was separated using a centrifugal separator, washed with water several times, and dried to obtain the product (Compound 1-1).

Preparation 2: Process (1) of using 2-acrylamido-2-methylpropanesulfonic acid as monomer While stirring 60 g of carbon black (Elftex 8) and 400 ml of water at 95° C., 12 g of potassium persulfate and 1.2 ml of tetramethylethylenediamine were added to the mixture. After stirring the mixture for 2 hours at 95° C., an aqueous solution of 2-acrylamido-2-methylpropanesulfonic acid (hereinafter, is referred to as AMPS) (a mixed solution of 250 ml of water, 11.6 g of sodium hydroxide, and 60 g of AMPS) was added to the mixture and after further adding 5.32 g of potassium persulfate and 2.68 ml of tetramethylethylenediamine to the mixture, the reaction was performed for 46 hours at 98° C. After allowing the reaction mixture to cool, dust was removed from the reaction mixture to provide the desired product (Compound 1-2).

Preparation 3: Process (2) of using AMPS as monomer

While stirring 60 g of carbon black (Mitsubishi 10B) and 300 ml of water at 70° C., 100 ml of an aqueous 12% sodium hypochlorite was added dropwise to the mixture over a 20 minute period. Thereafter, the reaction was performed for 120 minutes at 70° C. After increasing the temperature to 95° C., 12 g of potassium persulfate and 1.2 ml of tetramethylethylenediamine were added to the mixture. After stirring the resultant mixture for 2 hours at 95° C., an aqueous AMPS solution (a mixed solution of 250 ml of water, 11.6 g of sodium hydroxide, and 60 g of AMPS) was added to the mixture. Thereafter, 5.32 g of potassium persulfate and 2.68 ml of tetramethylethylenediamine were added to the mixture followed by performing the reaction for 46 hours at 98° C. After allowing the reaction mixture to cool, dust was removed therefrom to provide the desired product (Compound 1-3).

Comparison Preparation: Process of producing a comparison dispersion

Production of gelatin dispersion of carbon black (solid dispersion):

To 10 g of carbon black was gradually added 100 ml of an aqueous solution containing as a dispersing agent 0.5 g of Demor N (made by Kao Sekken K.K.) so that the surface of carbon black was sufficiently wet. Thereafter, the dispersion was dispersed by means of Auto Homo Mixer (made by Tokushu Kikai Kogyo K.K.) for 10 minutes at 5,000 rpm. The dispersion was further dispersed by means of Dynol Mill (KDL-type, made by Willy A Bachofen Manufacturing Engineers Co.) under the condition of 3,000 rpm and 40° C.

Thereafter, a 10% (wt) solution of gelatin (limed) was added to the dispersion thus obtained and the product was preserved in a refrigerator. (Dispersion 2).

EXAMPLE 1

With respect to Compounds 1-1 to 1-3 prepared by Preparations 1 to 3 and Dispersion 2, the stability to precipitation by centrifugal separation was determined. The centrifugal separation was performed at room temperature under the condition of 10,000 rpm and 20 minutes on 20 ml of each sample.

In the case of Dispersion 2 (Comparison sample), the supernatant became completely transparent and carbon black was precipitated but in the case of grafted compounds 1-1 to 1-3 (the compounds of this invention), no supernatant formed and each sample was in a uniformly dispersed state. From the results, it is understood that the dispersion stability of graft carbon is far superior to solid-dispersed carbon black (Dispersion 2).

EXAMPLE 2

For determining the effect of improving the photographic properties by the invention, gelatin dispersions (Didpersion 1-1 to 1-3) prepared as described below using graft polymer compounds of carbon black (Compounds 1-1 to 1-3) of this invention and the carbon black solid dispersion of Dispersion 2 as comparison sample were used for the test.

Production of Gelatin Dispersion of Graft Polymer Compound of Carbon Black

The pH of Compound 1-1 (200 g) was adjusted to 6.5 with 1N NaOH and then 150 ml of an aqueous 10% gelatin solution was gradually added to Compound 1-1 to provide a gelatin dispersion (Dispersion 1-1), which was preserved at a temperature lower than 10° C. During the addition of gelatin, the system was dispersed by means of Polytron (made by Kinematica Co.) at 5,000 rpm.

By following the same procedure as above using Compound 1-2 and Compound 1-3, gelatin dispersions (Dispersion 1-2 and Dispersion 1-3) were prepared.

Photosensitive Sheet

Photosensitive Sheet 1-1 were prepared by forming the following layers on a polyethylene terephthalate transparent support.

(1) An image-receiving layer containing 3 g/m$^2$ of the polymer having the following structure

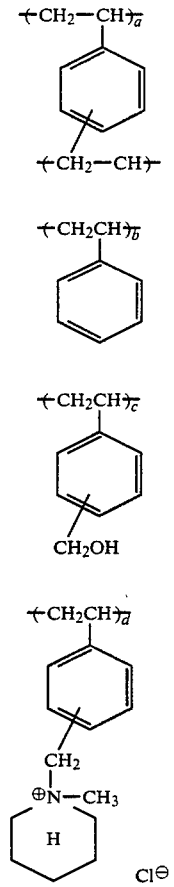

(a:b:c:d = 5:47.5:5.5:42)

3 g/m$^2$ of gelatin, and a coating aid having the following structure

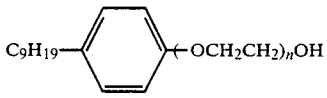

(n = about 30)

(2) A white reflecting layer containing 20 g/m² of titanium dioxide and 2.5 g/m² of gelatin.

(3) A light-shielding layer containing 1.5 g/m² of Compound 1-1 of this invention (as solid component of carbon black) and 0.75 g/m² of gelatin.

(4) A layer containing 0.44 g/m² of the cyan dye-releasing redox compound having the following structure, 0.09 g/m² of tricyclohexyl phosphate, 0.008 g/m² of 2,5-di-t-pentadecylhydroquinone, and 0.8 g/m² of gelatin.

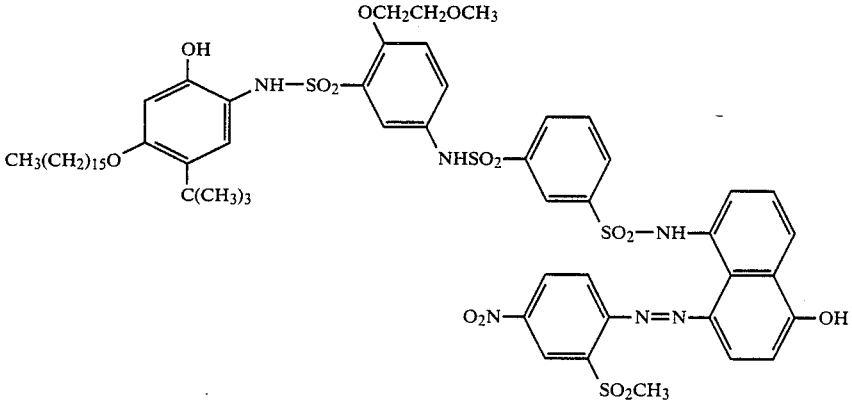

(5) A red-sensitive silver halide emulsion layer containing 1.03 g/m² (as silver amount) of a red-sensitive internal latent image type direct positive silver bromide emulsion, 1.2 g/m² of gelatin, 0.04 mg/m² of the nucleating agent having the following structure, and 0.13 g/m² of 2-sulfo-5-n-pentadecylhydroquinone sodium salt.

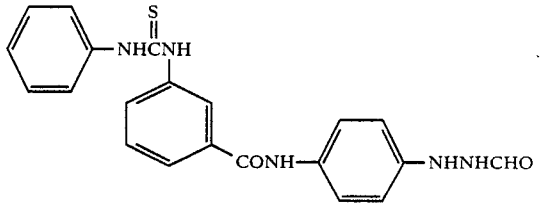

(6) A layer containing 0.43 g/m² of 2,5-di-t-pentadecylhydroquinone, 0.1 g/m² of trihexyl phosphate, and 0.4 g/m² of gelatin.

(7) A layer containing 0.21 g/m² of a magenta dye-releasing redox compound having the following structural formula I, 0.11 g/m² of magenta dye-releasing redox compound having the following structural formula II, 0.08 g/m² of tricyclohexyl phosphate, 0.009 g/m² of 2,5-di-t-pentadecylhydroquinone, and 0.9 g/m² of gelatin.

Structural Formula I

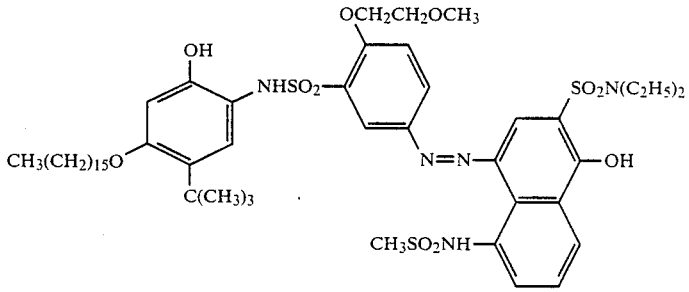

Structural Formula II

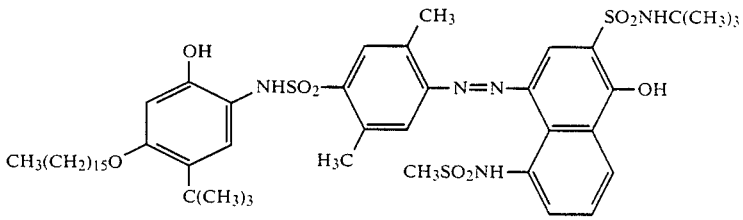

(8) A green-sensitive silver halide emulsion layer containing 0.82 g/m$^2$ (as silver amount) of a green-sensitive internal latent image type direct positive silver bromide emulsion, 0.9 g/m$^2$ of gelatin, 0.03 mg/m$^2$ of the nucleating agent having the same structure as used for layer (5), and 0.08 g/m$^2$ of 2-sulfo-5-n-pentadecylhydroquinone sodium salt.

(9) Same as layer (6).

(10) A layer containing 0.53 g/m$^2$ of a yellow dye-releasing redox compound having the following structure, 0.13 g/m$^2$ of tricyclohexyl phosphate, 0.014 g/m$^2$ of 2,5-di-t-pentadecylhydroquinone, and 0.7 g/m$^2$ of gelatin.

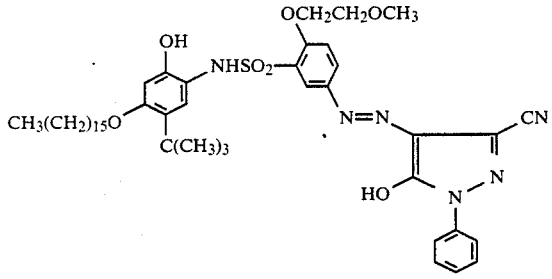

(11) A blue-sensitive silver halide emulsion layer containing 1.09 g/m$^2$ (as silver amount) of a blue-sensitive internal latent image type direct positive silver bromide emulsion, 1.1 g/m$^2$ of gelatin, 0.04 mg/m$^2$ of the nucleating agent having the same structure as used for layer (5), and 0.07 g/m$^2$ of 2-sulfo-5-n-pentadecylhydroquinone sodium salt.

(12) A layer containing 1.0 g/m$^2$ of gelatin.

Furthermore, by following the same procedure as above except that each of Compound 1-2, Compound 1-3, and Dispersion 2 was used in place of Compound 1-1 of this invention, Photosensitive Sheets 1-2, 1-3 and 2 (comparison sample) were prepared.

Cover Sheet

Cover Sheet (A) was prepared by forming, in succession, the following layers on a polyethylene terephthalate support.

(1) A neutralizing layer containing 22 g/m$^2$ of a copolymer of acrylic acid and butyl acrylate of 8:2 by mol ratio having a mean molecular weight of 50,000.

(2) A neutralization timing layer containing 4.5 g/m$^2$ of a mixture of (i) cellulose acetate having an acetylation degree of 51.3% (i.e., the amount of acetic acid released by the hydrolysis of it was 0.513 g per gram of the sample) and (ii) a copolymer of styrene and maleic anhydride of 1:1 by mol ratio having a mean molecular weight of about 10,000, at a weight ratio of the cellulose acetate to the copolymer of 95:5.

(3) A layer containing (i) a polymer latex prepared by emulsion polymerizing styrene, butyl acrylate, acrylic acid, and N-methylolacrylamide at 7/42.3/4/4 by weight ratio and (ii) a polymer latex prepared by emulsion polymerizing methyl methacrylate, acrylic acid, and N-methylolacrylamide at 93/3/4 by weight ratio, said polymer latex (i) and said polymer latex (ii) being blended at a solid content ratio of 6:4 and coated at a coverage of 1.6 g/m$^2$ (solid content).

After exposing each of foregoing Photosensitive Sheets 1-1, 1-2, 1-3 and 2 (comparison sheet) through a color test chart, the foregoing cover sheet was superposed on the exposed photosensitive sheet and then a processing composition having the following formulation was spread between both the sheets at a thickness of 85 microns (spreading was performed by the aid of press roller).

| Processing Composition: | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Carboxymethyl cellulose Na salt | 58 g |
| Potassium hydroxide (28% aq. soln.) | 200 ml |
| Benzyl alcohol | 1.5 ml |
| Carbon black | 150 g |
| Water | 685 ml |

Processing was performed at 35° C. and after 60 minutes following spread of the processing composition the color positive image formed in each sheet was measured with respect to the photographic properties and the results are shown in FIG. 1. That is, the densities (blue, green and red maximum and minimum reflection densities) of the color images are shown in Table 1.

TABLE 1

| Photosensitive Sheet | Red Density | | Green Density | | Yellow Density | |
|---|---|---|---|---|---|---|
| | Dmax | Dmin | Dmax | Dmin | Dmax | Dmin |
| 1-1 (Invention) | 2.45 | 0.330 | 2.35 | 0.245 | 2.10 | 0.285 |
| 1-2 (Invention) | 2.45 | 0.315 | 2.35 | 0.230 | 2.10 | 0.270 |
| 1-3 (Invention) | 2.45 | 0.335 | 2.35 | 0.245 | 2.05 | 0.285 |
| 2 (Comparison) | 2.30 | 0.395 | 2.15 | 0.280 | 2.05 | 0.320 |

As is clear from the results shown in Table 1, it is understood that in the sheets of this invention Dmin is 0.08 reduced in the maximum case as compared to that in the Comparison Sheet 2 and the highlights of the photographic images are greatly improved to improve the quality of the photographic images. Furthermore, in the sheets of this invention Dmax is increased and the tightness of the black portions of the photographic images is also improved.

EXAMPLE 3

For confirming the improved effect of this invention for photographic properties, each of the gelatin dispersion (Dispersion 1-1) of the graft polymer of carbon black of this invention and the comparison carbon black solid dispersion (Dispersion 2) was added to the processing composition and the test was performed using the processing composition.

A photosensitive sheet was prepared by the same manner as the photosensitive sheet in Example 2 except that the light-shielding layer composed of 1.5 g/m$^2$ of carbon black and 0.75 g/m$^2$ of gelatin was employed. A cover sheet was prepared by the same manner as the cover sheet in Example 2. A processing composition was prepared by the same manner as the processing composition in Example 2 except that carbon black in Dispersion 1-1 was concentrated under reduced pressure using an aspirator at 80° C. (Processing Composition 5-1). Also, a comparison processing composition was prepared using the comparison carbon black solid dispersion (Processing Composition 5-2).

Using the foregoing elements, the exposure, spreading of processing composition and the density measurement were performed as in Example 2. The results obtained are shown in Table 2.

TABLE 2

| Processing Composition | Red Density Dmin | Green Density Dmin | Yellow Density Dmin |
|---|---|---|---|
| 5-1 (Invention) | 0.345 | 0.255 | 0.300 |
| 5-2 (Comparison) | 0.395 | 0.280 | 0.320 |

From the above results, it is understood that the use of Processing Composition 5-1 of this invention gives lower Dmin and provides more clear images. Also, each of two kinds of the processing compositions was spread at a thickness of 30 microns to 100 microns and the light-shielding faculty thereof was evaluated. The results shows that the Processing Composition 5-1 of this invention gives less pinholes by the leakage of light and thus the aggregation of the processing composition at the preparation thereof is improved in this invention.

EXAMPLE 4

In order to show that the effects of this invention are not caused by the impurities, such as low molecular weight components, homopolymer, and polymerization initiator in the graft carbon polymer compound of this invention, the test was performed by adding the monomer or radical transfer used in the production process for the processing composition to the light-shielding layer.

Compound 1-2 in the Preparation 2 was placed in a dialysis tube followed by washing with water for about 16 hours and the sample thus obtained was used for the light-shielding layer. A photosensitive sheet was prepared by the same manner as the photosensitive sheet in Example 2 except that the aforesaid light-shielding layer was used (Photosensitive Sheet 6-1). Furthermore, a photosensitive sheet was prepared by the same manner of preparing the photosensitive sheet using Dispersion 2 in Example 2 except that 1.5 g/m$^2$ of 2-acrylamido-2-methylpropanesulfonic acid was added (Photosensitive Sheet 6-2). Still further, Photosensitive Sheet 6-3 was prepared by following the same manner of preparing Photosensitive Sheet 6-2 except that 500 mg/m$^2$ of tetramethylethylenediamine was used in place of 1.5 g/m$^2$ of 2-acrylamido-2-methylpropanesulfonic acid.

Then, the same exposure, spreading of processing composition, and density measurement as in Example 2 were performed and the results are shown in Table 3.

TABLE 3

| Photosensitive Sheet | Red Density Dmin | Green Density Dmin | Yellow Density Dmin |
|---|---|---|---|
| 1-2* | 0.315 | 0.230 | 0.270 |
| 6-1** | 0.315 | 0.230 | 0.270 |
| 6-2 | 0.390 | 0.280 | 0.320 |
| 6-3 | 0.400 | 0.275 | 0.320 |
| 2*** | 0.395 | 0.280 | 0.320 |

*The sheet of this invention.
**The sheet using dialyzed polymer compound.
***The comparison sheet.

By comparing the result of Photosensitive Sheet 1-2 with the result of Photosensitive Sheet 6-1 in Table 3, it is understood that the tendency of reducing Dmin in this invention is not changed by dialyzing the carbon black graft polymer of this invention. Also, since the photographic properties are not changed in Photosensitive Sheets 6-2, 6-3, and 2, it is clear that the improvements in this invention are not caused by the radical transfer and/or the monomer.

Thus, it is understood that the effect of this invention is caused by the use of the carbon black graft polymer of this invention.

While the invention has been described in detail and with reference to specific embodiments thereof, it will be apparent to one skilled in the art that various changes and modifications can be made therein without departing from the spirit and scope thereof.

What is claimed is:

1. A diffusion transfer photographic element, comprising:

a support having thereon at least one of a photosensitive silver halide emulsion layer and an image-receiving layer;

said photosensitive element containing a polymer compound obtained by graft polymerizing a monomer compound to a pigment;

wherein the pigment is carbon black.

2. The diffusion transfer photographic element as claimed in claim 1, wherein the monomer compound is an anionic monomer.

3. The diffusion transfer photographic element as claimed in claim 1, wherein the monomer compound is 2-acrylamido-2-methylpropanesulfonic acid or an alkali metal salt thereof.

4. The diffusion transfer photographic element as claimed in claim 1, wherein the monomer compound is acrylic acid or an alkali metal salt thereof.

5. The diffusion transfer photographic element as claimed in claim 1, wherein said photographic element has at least one photosensitive silver halide emulsion layer and at least one image-receiving layer on the same or different support from each other.

6. The diffusion transfer photographic element as claimed in claim 5, wherein the photosensitive silver halide emulsion layer has a dye image-providing material associated therewith.

7. The diffusion transfer photographic element as claimed in claim 5, wherein the element is comprised of a plurality of photosensitive silver halide emulsion layers having associated therewith a dye image-providing material.

8. A lamination integral type color diffusion transfer material comprising a photosensitive sheet having formed, in succession, on a transparent support, an image-receiving layer, a white reflecting layer, a light-shielding layer, a layer containing a cyan dye image-providing material, a red-sensitive silver halide emulsion layer, an interlayer, a layer containing a magenta dye image-providing material, a green-sensitive silver halide emulsion layer, an interlayer, a layer containing a yellow dye image-providing material, a blue-sensitive silver halide emulsion layer, and a protective layer; a cover sheet having on another transparent support a neutralizing layer and a neutralization timing layer; said photosensitive sheet being superposed on said cover sheet in a face-to-face relationship; and a pressure rupturable container containing a carbon black-containing processing composition capable of spreading the processing composition between said two sheets; said light-shielding layer of the photosensitive sheet contains a polymer compound obtained by graft polymerizing a monomer compound to carbon black.

9. The diffusion transfer photographic element as claimed in claim 1, wherein the carbon black is comprised of particles having a size in a range of 90 to 1,800 Å.

10. The diffusion transfer photographic element as claimed in claim 9, wherein the grafting rate of the monomer to the carbon black is 1 to 200%.

11. The diffusion transfer photographic element as claimed in claim 10, wherein the carbon black is present in an amount in the range of 0.5 to 5.0 g/m$^2$ as a solid content.

12. The diffusion transfer photographic element as claimed in claim 11, wherein the carbon black is present in an amount in the range of 1.0 to 3.0 g/m$^2$ as a solid content.

13. The diffusion transfer photographic element as claimed in claim 1, wherein the carbon black is present in a processing composition associated with the element in an amount in the range of 15 to 500 g per 1,000 g of processing composition.

14. The diffusion transfer photographic element as claimed in claim 13, wherein the carbon black is present in the processing composition in an amount in the range of 50 to 250 g per 1,000 g of processing composition.

15. The diffusion transfer photographic element as claimed in claim 1, wherein the polymer compound is present in a photographic layer of the element.

16. The diffusion transfer photographic element as claimed in claim 1, wherein the grafting rate is 5 to 100%.

17. The diffusion transfer photographic element as claimed in claim 1, wherein the graft polymerization is performed in an aqueous medium.

18. The diffusion transfer photographic element as claimed in claim 1, wherein the aggregation of carbon black is reduced.

19. The diffusion transfer photographic element as claimed in claim 1, wherein the monomer compound is a water-soluble monomer compound.

20. The diffusion transfer photographic element as claimed in claim 19, wherein the grafting rate of the monomer to the carbon black is 1 to 200%.

21. The diffusion transfer photographic element as claimed in claim 20, wherein the carbon black is comprised of particles having a size in a range of 90 to 1,800 Å.

22. The diffusion transfer photographic element as claimed in claim 21, wherein the carbon black is present in an amount in the range of 0.5 to 5.0 g/m$^2$ as a solid content.

23. The diffusion transfer photographic element as claimed in claim 22, wherein the carbon black is present in an amount in the range of 1.0–3.0 g/m$^2$ solid content.

24. The diffusion transfer photographic element as claimed in claim 20, wherein the carbon black is present in a processing composition associated with the element in an amount in the range of 15 to 500 g per 1,000 g of processing composition.

25. The diffusion transfer photographic element as claimed in claim 24, wherein the carbon black is present in the processing composition in an amount in the range of 50 to 250 g per 1,000 g of processing composition.

26. The diffusion transfer photographic element as claimed in claim 20, wherein the polymer compound is present in a photographic layer of the element.

27. The diffusion transfer photographic element as claimed in claim 20, wherein the grafting rate is 5 to 100%.

* * * * *